US008783071B2

(12) United States Patent
Ko et al.

(10) Patent No.: US 8,783,071 B2
(45) Date of Patent: Jul. 22, 2014

(54) WASHING MACHINE

(75) Inventors: Hong Seok Ko, Yongin-si (KR); Dae Yeong Hong, Suwon-si (KR); Sang Up Lee, Yongin-si (KR); Yong Kwon Kim, Daejeon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 710 days.

(21) Appl. No.: 12/805,120

(22) Filed: Jul. 13, 2010

(65) Prior Publication Data

US 2011/0041567 A1 Feb. 24, 2011

(30) Foreign Application Priority Data

Aug. 24, 2009 (KR) ..... 10-2009-0077960

(51) Int. Cl.
*D06F 39/02* (2006.01)
*D06F 39/08* (2006.01)

(52) U.S. Cl.
USPC ..... 68/17 R; 68/11; 68/12.18; 68/27

(58) Field of Classification Search
USPC ..... 68/17 R
See application file for complete search history.

(56) References Cited

U.S. PATENT DOCUMENTS

| | | | | |
|---|---|---|---|---|
| 2005/0229652 | A1* | 10/2005 | Kim et al. | 68/237 |
| 2006/0086155 | A1* | 4/2006 | Kim et al. | 68/196 |
| 2008/0072631 | A1* | 3/2008 | Je et al. | 68/17 R |
| 2008/0256721 | A1* | 10/2008 | Kim et al. | 8/158 |
| 2009/0133198 | A1* | 5/2009 | Lee et al. | 8/158 |

FOREIGN PATENT DOCUMENTS

| | | |
|---|---|---|
| CN | 101168913 A | 4/2008 |
| KR | 10-2003-0009847 | 2/2003 |
| KR | 10-2004-0009400 | 1/2004 |
| KR | 10-2007-0059440 | 6/2007 |

OTHER PUBLICATIONS

Chinese Office Action mailed Dec. 11, 2013 in corresponding Chinese Application No. 201010248449.1.

* cited by examiner

*Primary Examiner* — Joseph L Perrin
*Assistant Examiner* — Levon J Shahinian
(74) *Attorney, Agent, or Firm* — Staas & Halsey LLP

(57) ABSTRACT

Disclosed herein is a washing machine including a pair of tubs disposed in a main body and a detergent supply device to supply any one of the pair of tubs. A first detergent storage part, into which a first detergent is put, and a second detergent storage part, into which a second detergent is put, disposed above the first detergent storage part are provided in the detergent supply device, thereby reducing a width of the detergent supply device.

17 Claims, 7 Drawing Sheets

WASHING MACHINE

CROSS-REFERENCE TO RELATED APPLICATION

This application claims the benefit of Korean Patent Application No. 2009-0077960, filed on Aug. 24, 2009 in the Korean Intellectual Property Office, the disclosure of which is incorporated herein by reference.

BACKGROUND

1. Field

Embodiments relate to a washing machine having a detergent supply device to supply a detergent to a tub.

2. Description of the Related Art

In general, washing machines are apparatuses, each of which includes a tub and a drum, and washes contaminated laundry using water and a detergent. The washing machines include drum washing machines, which wash laundry by differences in elevation.

A drum washing machine includes a tub installed in a main body to contain water, a drum rotatably installed in the tub, a water supply device to supply water to the tub and the &Um, a drain device to discharge used water to the outside of the main body after washing, and a detergent supply device to dissolve a detergent in water in connection with the water supply device.

A washing machine including a first washing unit and a second washing unit vertically arranged to simultaneously wash laundry of different types has been recently proposed. Each of the first washing unit and the second washing unit of such a washing machine includes a tub and a drum such that the first washing unit and the second washing unit may independently perform washing.

Further, the first washing unit and the second washing unit of the washing machine respectively include a first detergent supply device to supply a detergent to the tub of the first washing unit and a second detergent supply device to supply a detergent to the tub of the second washing unit such that the detergents are independently supplied to the tubs of the first washing unit and the second washing unit.

SUMMARY

It is one aspect to provide a washing machine in which a detergent is more conveniently supplied to a detergent supply device.

Additional aspects will be set forth in part in the description which follows and, in part, will be apparent from the description, or may be learned by practice of the invention.

The foregoing and/or other aspects are achieved by providing a washing machine including a main body, a pair of tubs disposed in the main body, a detergent case, provided with an opened front surface, and including a first detergent storage part, into which a first detergent to be supplied to any one of the pair of tubs is put, formed on a bottom of the detergent case, and a detergent box separably installed in the detergent case through the opened front surface of the detergent case, and including a second detergent storage part, into which a second detergent is put, disposed higher than the first detergent storage part.

The washing machine may further include a water supply guide installed on the upper surface of the detergent case to dispersedly supply water to the second detergent storage part, a main water supply pipe connected to the detergent case to supply water to the first detergent storage part, and a sub water supply pipe connected to the water supply guide to supply water to the second detergent storage part.

The pair of tubs may include a first tub disposed in the upper portion of the main body and a second tub disposed in the lower portion of the main body, and the first detergent and the second detergent to be supplied to the first tub may be respectively put into the detergent case and the detergent box.

A holding part, on which the detergent box separated from the main body is held, may be provided.

The washing machine may further include a holder including the holding part, on which the detergent box separated from the main body is held.

The holder may be rotatably installed on the main body, and be rotated to protrude from the main body. One end of the holder may be rotatably installed on the main body, and the holding part may be formed on the inner surface of the holder. A through hole, through which the holder is inserted into the main body, may be provided on the main body, and be opened and closed by a cover. The holder may include a wire holder. The holder may include the holding part, on which the detergent box is held, and hinge parts rotatably installed on the main body.

The detergent box may include a grip provided in front of the second detergent storage part to grasp the detergent box, and the holding part may be formed in a shape corresponding to the external shape of the grip.

An entrance hole opened and closed by a door may be formed through a front surface of the main body, a gasket connecting the entrance hole and an opening formed through a front surface of a drum may be provided, and the holding part may be formed in a concave shape on the gasket.

The washing machine may further include first magnetic bodies and second magnetic bodies respectively installed on corresponding surfaces of the detergent box and the detergent case to maintain the state of the detergent box installed in the detergent case by magnetic force.

The washing machine may further include a diaphragm formed on the detergent case to divide the first detergent storage part.

The washing machine may further include a discharge guide pipe protruded upwardly from the second detergent storage part to discharge the detergent in the detergent box to the detergent case, and a cap to cover the upper end of the discharge guide pipe when the cap is separated from the upper end of the discharge guide pipe. Further, a plurality of stepped parts extended in the centrifugal direction of the cap may be formed in the circumferential direction.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
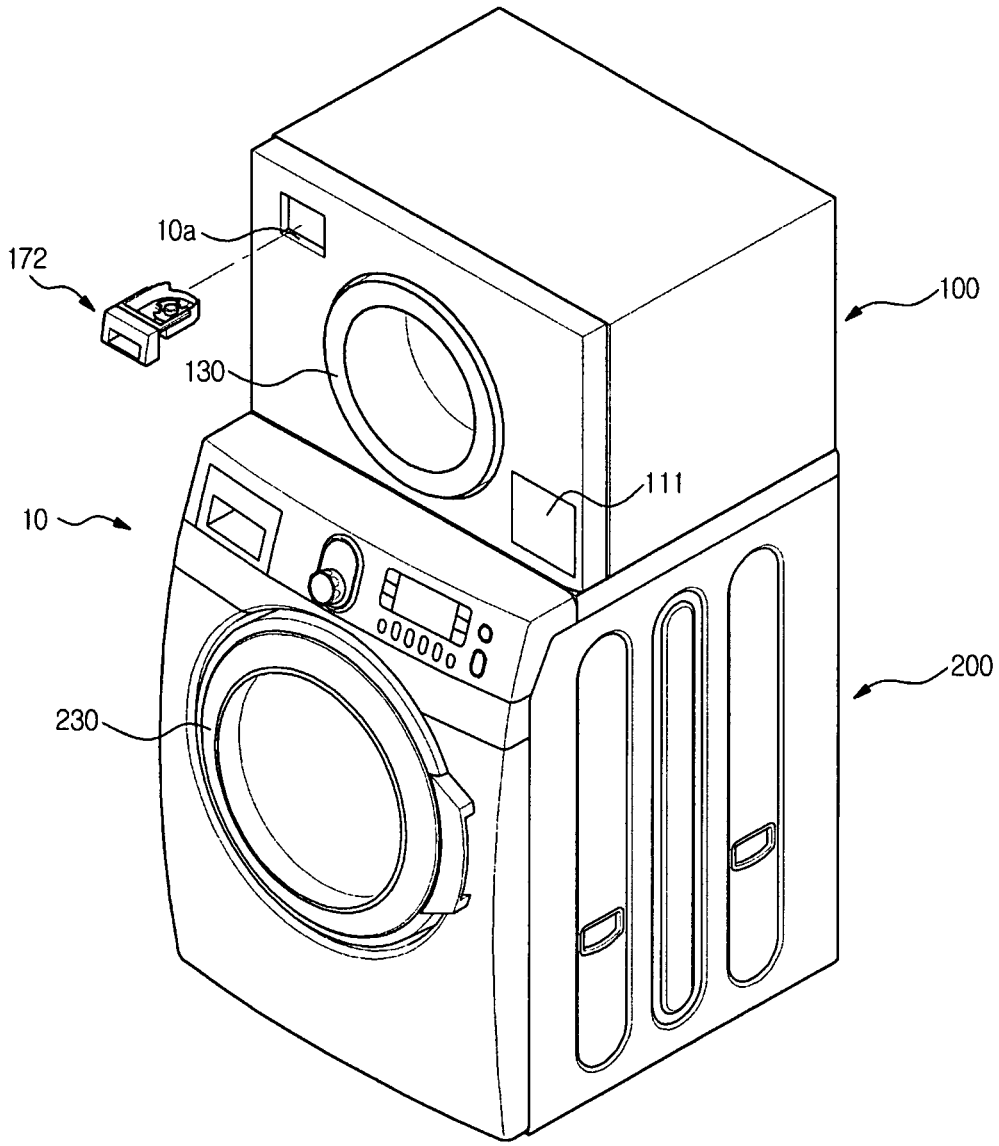
FIG. 1 is a perspective view of a washing machine in accordance with one embodiment.

Reference will now be made in detail to the embodiments, examples of which are illustrated in the accompanying drawings, wherein like reference numerals refer to like elements throughout.

As shown in FIG. 1, a washing machine in accordance with one embodiment is a twin-type washing machine in which a plurality of washing units 100 and 200 to perform washing is installed in a main body 10 forming the external appearance of the washing machine. In this embodiment, the plurality of washing units 100 and 200 includes a first washing unit 100 and a second washing unit 200, which are arranged vertically and are operated independently.

Figure 2:
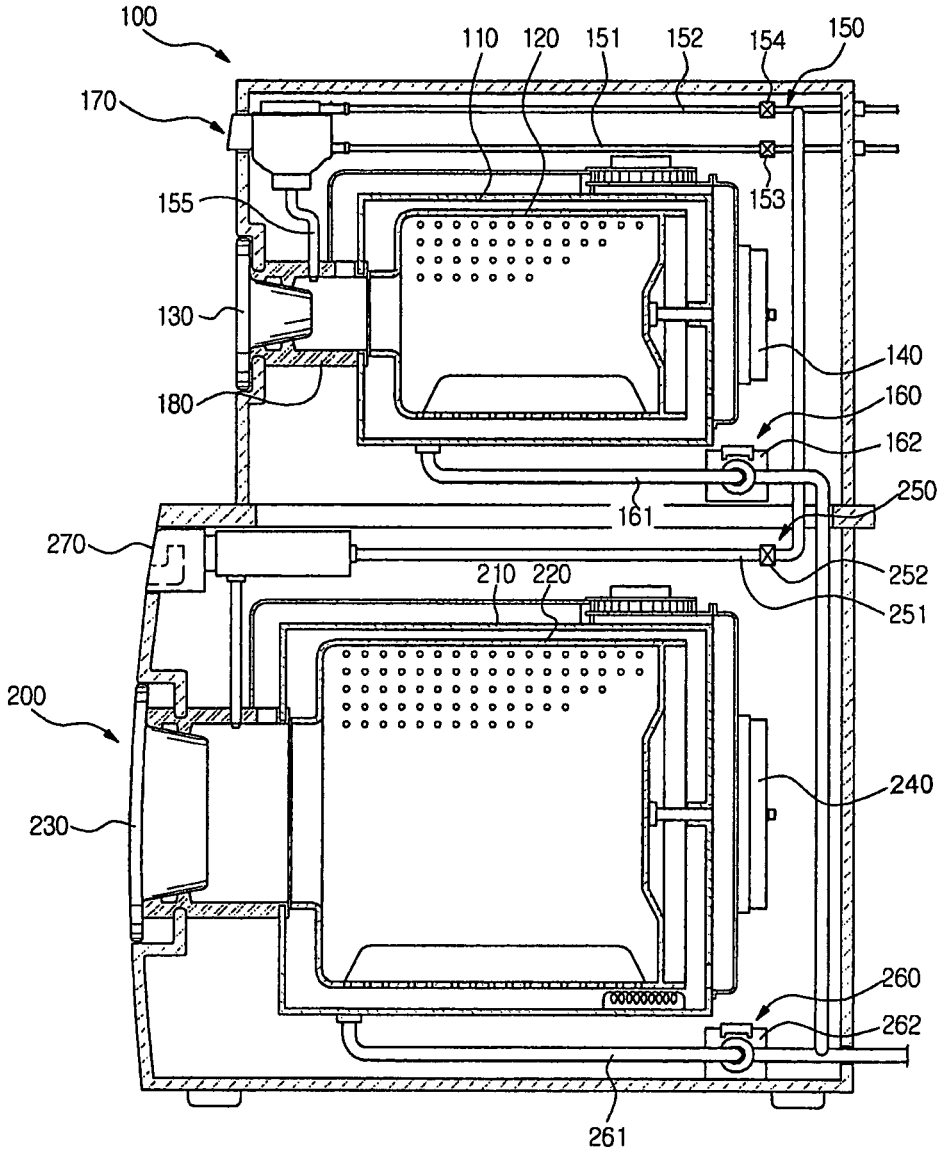
FIG. 2 is a longitudinal-sectional view of the washing machine in accordance with the embodiment.

As shown in FIG. 2, tubs 110 and 210 disposed in the main body 10 to contain water used in washing, drums 120 and 220 rotatably installed in the tubs 110 and 210 and rotated to wash laundry by the difference in elevation, driving devices 140 and 240 to rotate the drums 120 and 220, water supply devices 150 and 250 to supply water to be used in washing to the tubs 110 and 210, drain devices 160 and 260 to discharge water used in washing to the outside of the main body 10, and detergent supply devices 170 and 270 to dissolve detergents in water to be supplied to the tubs 110 and 120 in connection with the water supply devices 150 and 250 are disposed in the main body 10.

Since the washing machine in accordance with this embodiment includes the first washing unit 100 and the second washing unit 200, which are operated independently, the tubs 110 and 210 include a first tub 110 disposed in the upper portion of the inside of the main body 10 and a second tub 210 disposed in the lower portion of the inside of the main body 10. The drums 120 and 220 include a first drum 120 and a second drum 220 rotatably installed in the first tub 110 and the second tub 210 respectively. A pair of the driving devices 140 and 240, a pair of the water supply devices 150 and 250, a pair of the drain devices 160 and 260, and a pair of the detergent supply devices 170 and 270 are provided, thereby independently achieving washing in the first tub 110 and the second tub 210.

That is, the driving devices 140 and 240 include a first driving device 140 and a second driving device 240 to respectively rotate the first drum 120 and the second drum 220, the water supply devices 150 and 250 include a first water supply device 150 and a second water supply device 250 to respectively supply water to the first tub 110 and the second tub 210. The drain devices 160 and 260 include a first drain device 160 and a second drain device 260 to respectively discharge water in the first tub 110 and the second tub 210, and the detergent supply devices 170 and 270 include a first detergent supply device 170 and a second detergent supply device 270, into which detergents to be supplied to the first tub 110 and the second tub 210 are respectively put.

A first door 130 and a second door 230, through which a user respectively puts laundry into the first drum 120 and the second drum 220, are installed on the front surface of the main body 10.

Among the first tub 110 and the second tub 210, one tub having a relatively high volume may be used as the second tub 210, and the other tub having a relatively low volume may be used as the first tub 110, in consideration of vibration and stability.

The first water supply device 150 includes first water supply pipes 151 and 152 to guide water to the first tub 110, and first water supply valves 153 and 154 respectively installed on the first water supply pipes 151 and 152 to open and close the first water supply pipes 151 and 152. The first water supply pipes 151 and 152 include a main water supply pipe 151 serving both to supply water to be supplied to the first tub 110 during a washing or rinsing cycle and to supply water to be mixed with a first detergent, such as a powdered detergent, and a sub water supply pipe 152 serving to supply water to be mixed with a second detergent, which is a liquid sub detergent, such as a fabric rinse or a bleach. The first water supply valves 153 and 154 include a main water supply valve 153 and a sub water supply valve 154 to respectively open and close the main water supply pipe 151 and the sub water supply pipe 152. The second water supply device 250 includes a second water supply pipe 251 to guide water to the second tub 210, and a second water supply valve 252 installed on the second water supply pipe 251 to open and close the second water supply pipe 251.

The first drain device 160 includes a first drain pipe 161 to guide water in the first tub 110 to the outside, and a first drain pump 162 installed on the first drain pipe 161 to discharge water in the first tub 110 to the outside. The second drain device 260 includes a second drain pipe 261 to guide water in the second tub 210 to the outside, and a second drain pump 262 installed on the second drain pipe 261 to discharge water in the second tub 210 to the outside.

Figure 3:
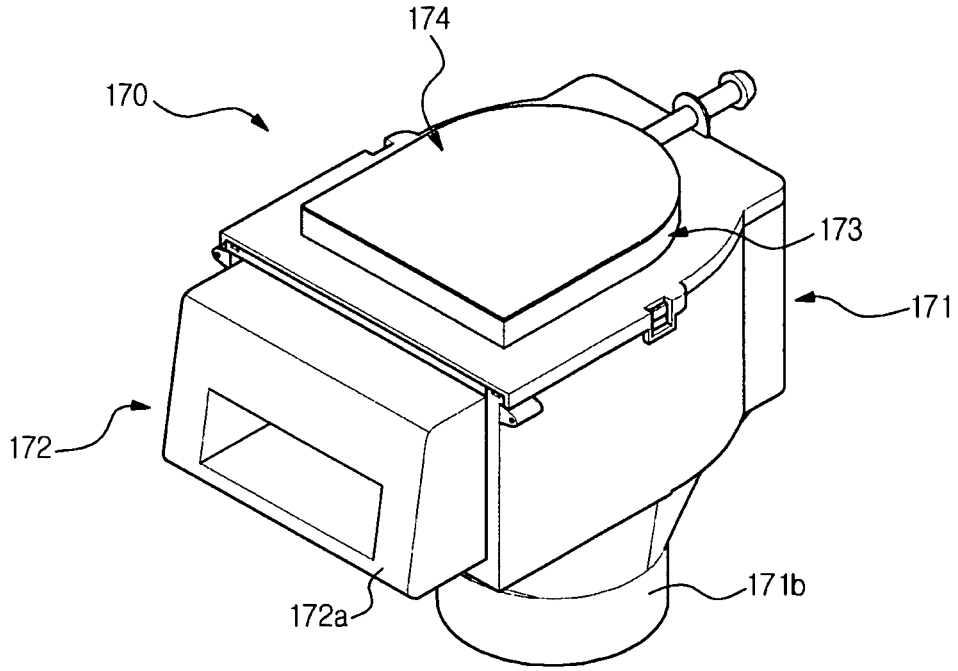
FIG. 3 is a perspective view of a first detergent supply device of the washing machine in accordance with the embodiment.
Figure 4:
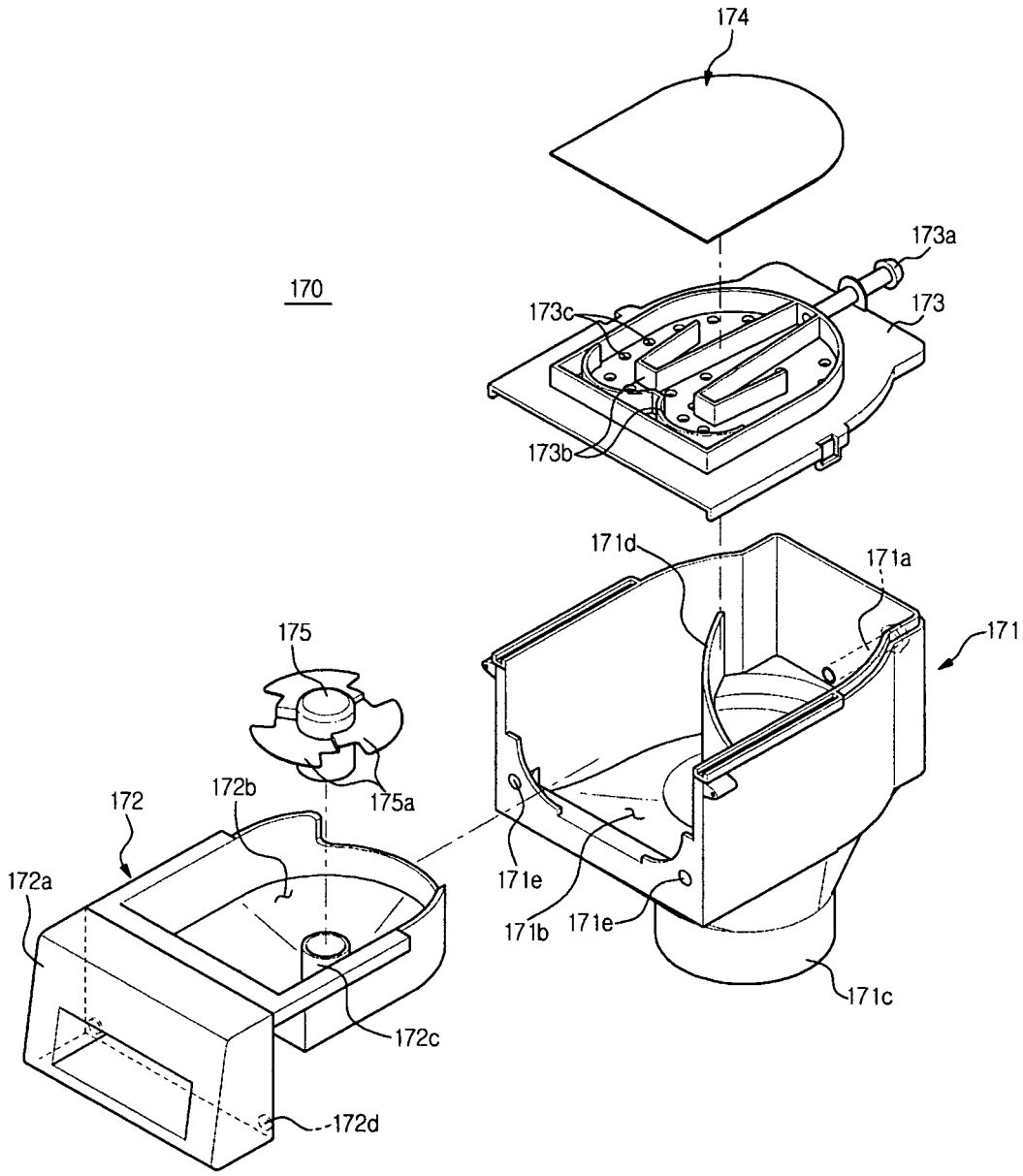
FIG. 4 is an exploded perspective view of the first detergent supply device of the washing machine in accordance with the embodiment.

The first detergent supply device 170, as shown in FIGS. 3 and 4, includes a detergent case 171 installed in the main body 10 close to the front surface of the main body 10, a detergent box 172 separably installed in the detergent case 171 and separated from the detergent case 171 and the main body 10, a water supply guide 173 disposed to cover the upper surface of the detergent case 171 and located above the detergent box 172 when the detergent box 172 is installed in the detergent case 171, so as to dispersedly supply water to the upper portion of the detergent box 172, and a cover plate 174 to cover the upper portion of the water supply guide 173.

The front surface of the detergent case 171 is opened such that the first detergent, which is a powdered main detergent, is put into the detergent case 171, and the upper surface of the detergent case 171 is opened such that water dispersed by the water supply guide 173 is supplied to the detergent box 172. The detergent box 172 is installed in the detergent case 171 such that the detergent box 172 is separated from the detergent case 171 through the opened front surface of the detergent case 171, and is separated from both the detergent case 171 and the main body 10.

A first detergent storage part 171*b* to contain the first detergent is provided on the bottom of the detergent case 171, a main water supply port 171*a*, to which the main supply pipe 151 is connected, is extended from the rear surface of the detergent case 171, and a connection port 171*c*, to which a connection pipe 155 connecting the first tub 110 and the detergent case 171 is connected, is formed through the lower surface of the detergent case 171, thereby allowing the first or second detergent mixed with water to be supplied to the first tub 110. Further, a diaphragm 171*d* to prevent water supplied to the detergent box 172 through the main water supply port 171*a* or the water supply guide 173 from leaking through the opened front surface of the detergent case 171 is provided in the detergent case 171 so as to divide the first detergent storage part 171*b*.

The detergent box 172 includes a grip 172*a* allowing a user to easily grasp the detergent box 172, and a second detergent storage part 172*b* formed integrally with the rear surface of the grip 172*a* to contain the second detergent. The upper surface of the second detergent storage part 172*b* is opened, and is disposed above the first detergent storage part 171*b*. A discharge guide pipe 172*c* to cause the second detergent mixed with water to be discharged to the detergent case 171 is protruded upwardly from the center of the second detergent storage part 172*b*, and a cap 175 covers the upper end of the discharge guide pipe 172*c* under the condition that the cap 175 is separated from the upper end of the discharge guide pipe 172*c* by a designated distance so as to allow the second detergent in a liquid state to be discharged through the discharge guide pipe 172*c* by siphon force. A plurality of stepped parts 175*a*, extended in the centrifugal direction of the cap 175 to allow a user to judge an amount of the detergent put into the detergent box 172, is formed in the circumferential direction.

If the first detergent storage part 171*b* and the second detergent storage parts 172*b* are disposed vertically by arranging the detergent case 171 and the detergent box 172 as described, a width of the first detergent supply device 171 is considerably reduced, and the inner space of the main body 10 may be efficiently utilized.

First magnetic bodies 171*e* and second magnetic bodies 172*d* to maintain the state of the detergent box 172 installed in the detergent case 171 by magnetic force are respectively installed at corresponding positions of corresponding surfaces of the detergent box 172 and the detergent case 171, i.e., the rear surface of the grip 172*a* of the detergent box 172, and the front surface of the detergent case 171.

The water supply guide 173 includes a sub water supply port 173*a* extended backwardly such that the sub water supply pipe 152 is connected to the sub water supply port 173*a*, and guide parts 173*b* protruded upwardly to form a channel and thus to disperse water introduced through the sub water supply port 173*a*. Further, the water supply guide 173 is provided with a plurality of discharge holes 173*c* to discharge water dispersed by the guide parts 173*b* to the detergent box 172 disposed under the water supply guide 173.

As shown in FIG. 1, a mounting hole 10*a* provided in a front of the main body 10 such that the detergent box 172 is installed in the detergent case 171 installed in the main body 10 through the mounting hole 10*a*, and a holder 111 provided at a lower position than that of the mounting hole 10*a* such that the detergent box 172 separated from the main body 10 is held by the holder 111.

Figure 5:
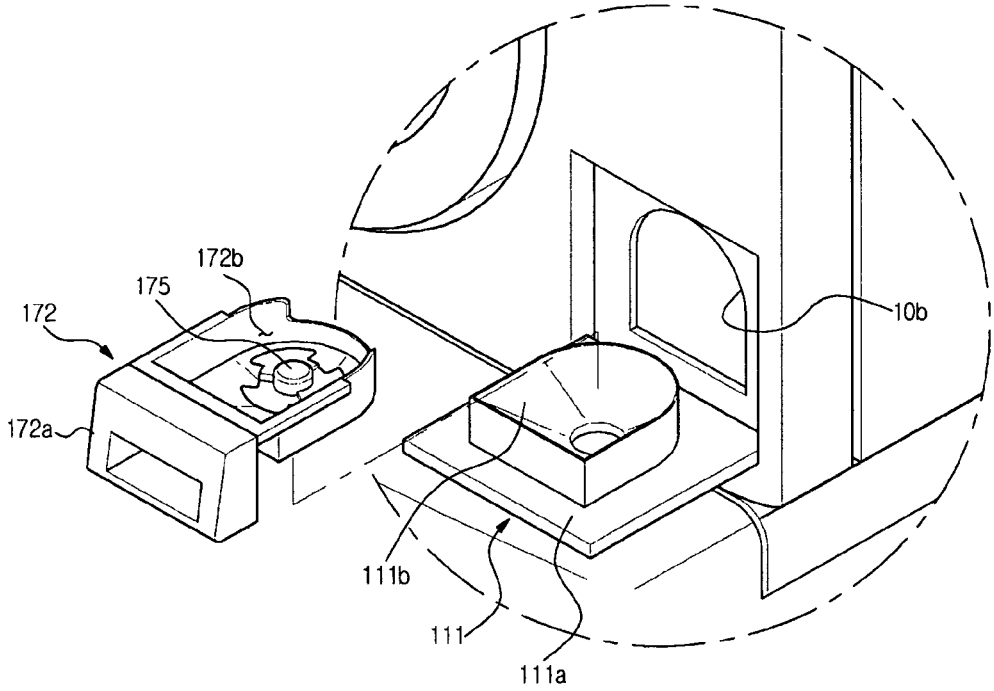
FIG. 5 is a perspective view of a holder applied to the washing machine in accordance with the embodiment.

As shown in FIG. 5, the holder 111 allows a user to easily put the detergent into the detergent box 172 of the first detergent supply device 170 disposed at a higher position than that of the center of the first tub 110 so as to supply the detergent to the inside of the first tub 110. In this embodiment, the holder 111 includes a cover part 111*a* formed in a panel shape and provided with one end rotatably connected to the front surface of the main body 10, and a holding part 111*b* provided on the inner surface of the cover part 111*a* such that the detergent box 172 separated from the detergent case 171 and the main body 10 is supported on the holding part 111*b*. The holding part 111*b* has a concave shape corresponding to the lower surface of the second detergent storage part 172*b* of the detergent box 172 such that the detergent box 172 is laid on the holding part 111*b*. A through hole 10*b*, through which the holding part 111*b* is inserted into the main body 10, is formed on the front surface of the main body 10, and the through hole 10*b* is closed by the cover part 111*a* of the holder 111.

Therefore, if a user wants to put the second detergent into the detergent box 172, the holder 111, disposed when the cover part 111*a* closes the through hole 10*b*, is rotated and is protruded forwardly, the detergent box 172 is separated from the main body 10 and the detergent case 171, and then the lower surface of the second detergent storage part 172*b* of the detergent box 172 is held on the holding part 111*b* exposed upwardly. Since the holder 111 is located at a lower position that that of the detergent case 171, the user may put the second detergent in the liquid state into the second detergent storage part 172*b* while looking down the second detergent storage part 172*b* of the detergent box 172 held on the holder 111 placed at the low position, thereby precisely putting a proper amount of the detergent into the second detergent storage part 172*b*.

Figure 6:
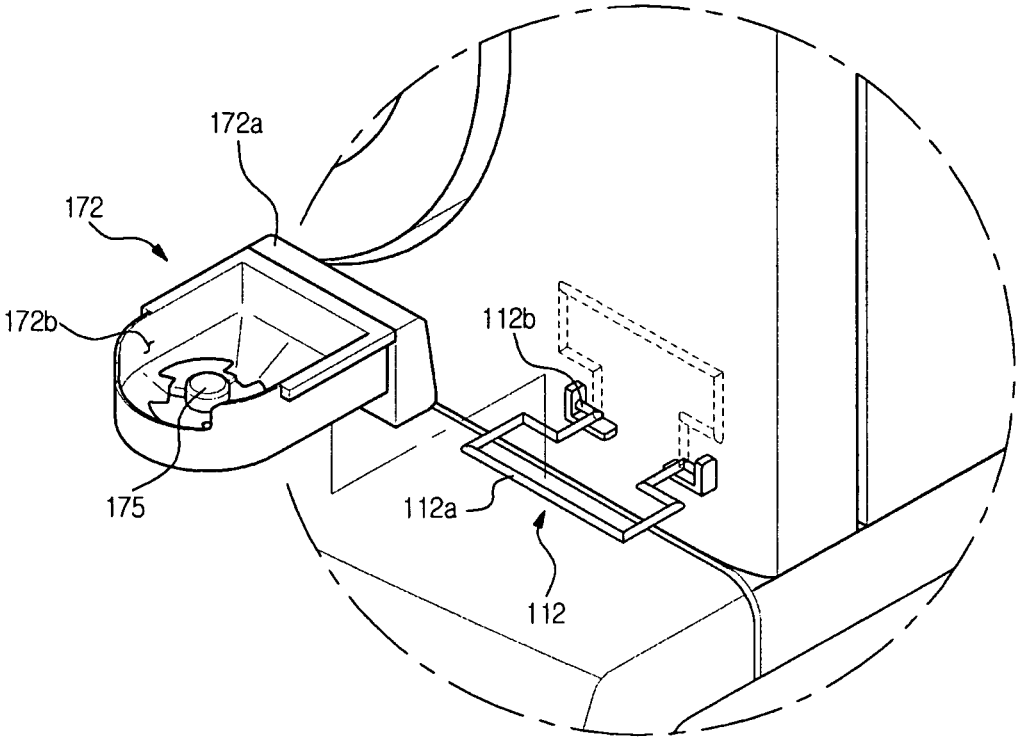
FIG. 6 is a perspective view of a holder applied to a washing machine in accordance with a further embodiment.

Although this embodiment illustrates the holder 111 including the cover part 111*a* and the holding part 111*b*, a wire holder 112 formed by bending a wire may be provided, as shown in FIG. 6 in accordance with a further embodiment. Such a wire holder 112 includes a holding part 112*a* formed in a shape corresponding to the external shape of the grip 172*a*, and a pair of hinge parts 112*b* extended integrally from the holding part 112*a* and rotatably connected to the main body 10. In the wire holder 112, the holding part 112*a* is rotated around the hinge parts 111*b*, and is protruded from the main body 10.

Further, the wire holder 112 may be installed on the first door 130 as well as the main body 10, i.e., installed at various positions of the washing machine, so as to hold the detergent box 172.

Figure 7:
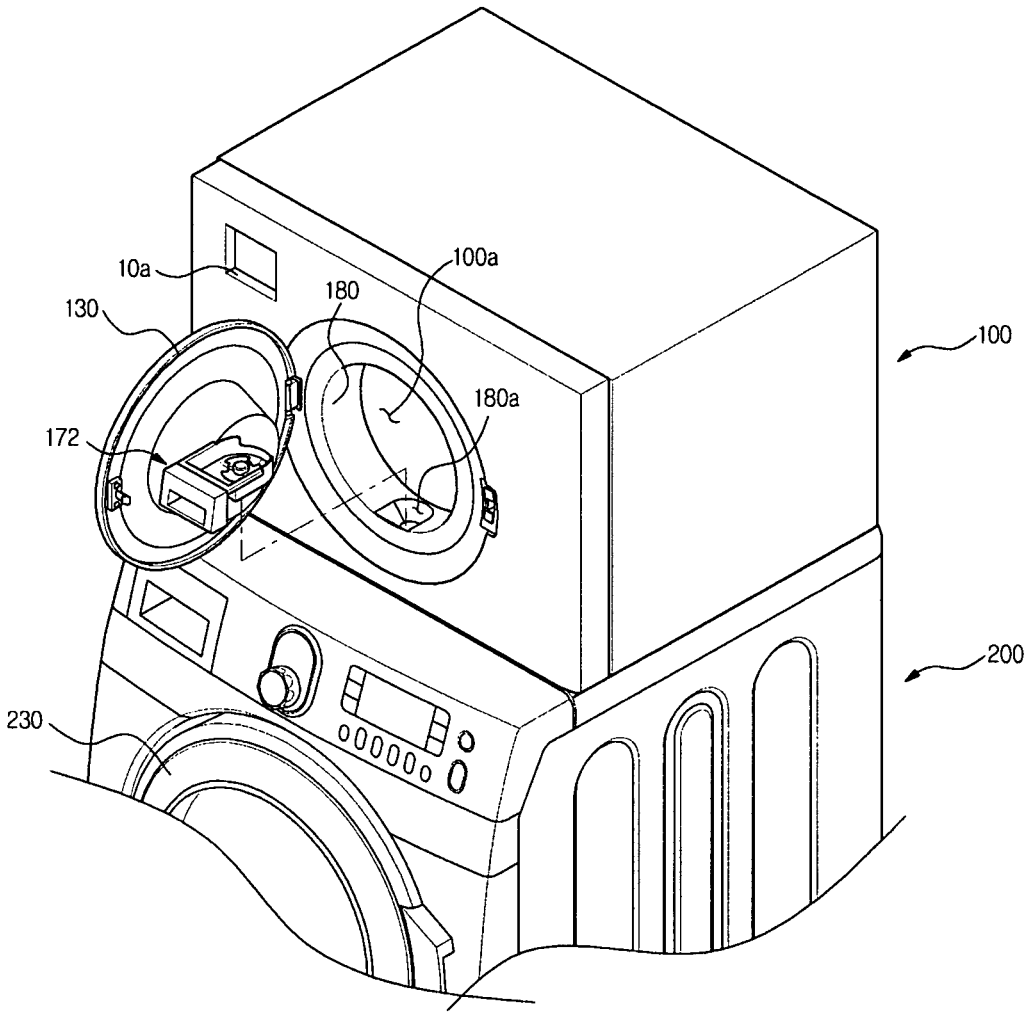
FIG. 7 is a perspective view of a holding part applied to a washing machine in accordance with another embodiment.

Although the above embodiment illustrates that the holding part 111*b* is formed on the holder 111, the position of the holding part is not limited thereto. That is, as shown in FIG. 7 in accordance with another embodiment, a holding part 180*a* having a concave shape may be formed on a gasket 180 connecting an entrance hole 100*a* of the main body 10, which is opened and closed by the first door 130, and an opening formed through the front surface of the drum 120.

Although the above-described embodiments illustrate two tubs 110 and 210, i.e., the first tub 110 and the second tub 210 vertically disposed, the holder may be used, even if plural tubs are vertically disposed and a detergent box to supply a detergent to any one of the plurality of tubs is located at an excessively high or low position, thereby allowing a user to easily put the detergent into the detergent box.

As is apparent from the above description, in a washing machine in accordance with one embodiment, a second detergent storage part of a detergent box is provided above a first detergent storage part of a detergent case, thereby reducing a width of a detergent supply device including the detergent case and the detergent box.

Further, the detergent box is separated from the detergent case and then is held on a holding part provided at a lower position than that of the detergent case, in which the detergent box is installed, thereby allowing a user to easily put a detergent into the detergent box.

Although a few embodiments have been shown and described, it would be appreciated by those skilled in the art that changes may be made in these embodiments without departing from the principles and spirit of the embodiments, the scope of which is defined in the claims and their equivalents.

What is claimed is:

1. A washing machine comprising:

a main body;

at least one tub disposed in the main body; and a detergent supply device including:

a detergent case including a first detergent storage part configured to receive a first detergent, integrally formed with a bottom of the detergent case; and a detergent box separably installed in the detergent case, and including a second detergent storage part, configured to receive a second detergent, the second detergent storage part disposed directly above the first detergent storage part when the detergent box is installed in the detergent case, wherein water supplied to the second detergent storage part flows via the first detergent storage part, and then the water is supplied to the at least one tub in a state that includes the second detergent being separate from the first detergent.

2. The washing machine according to claim 1, further comprising:

a water supply guide installed on an upper surface of the detergent case to dispersedly supply water to the second detergent storage part;

a main water supply pipe connected to the detergent case to supply water to the first detergent storage part; and a sub water supply pipe connected to the water supply guide to supply water to the second detergent storage part.

3. The washing machine according to claim 1, wherein the at least one tub includes a pair of tubs, and wherein the pair of tubs includes a first tub disposed in an upper portion of the main body and a second tub disposed in a lower portion of the main body, and the first detergent and the second detergent to be supplied to the first tub are respectively put into the detergent case and the detergent box.

4. The washing machine according to claim 3, further comprising a holding part, on which the detergent box separated from the main body and the detergent case are held.

5. The washing machine according to claim 4, further comprising a holder on which the detergent box separated from the main body is held, the holder comprising the holding part.

6. The washing machine according to claim 5, wherein the holder is rotatably installed on the main body, and is rotated to protrude from the main body.

7. The washing machine according to claim 5, further comprising a through hole through which the holder is inserted into the main body; and a cover to open and close the through hole.

8. The washing machine according to claim 4, further comprising:

a door, an entrance hole opened and closed by the door, the entrance hole being formed through a front surface of the main body;

a gasket; and an opening formed through a front surface of a drum, the gasket connecting the entrance hole and the opening, the holding part being formed in a concave shape on the gasket.

9. The washing machine according to claim 4, further comprising a plurality of first magnetic bodies and a plurality of second magnetic bodies respectively installed on corresponding surfaces of the detergent box and the detergent case to maintain a position of the detergent box installed in the detergent case by magnetic force.

10. The washing machine according to claim 3, wherein the first detergent put into the first detergent storage part is adapted to be supplied to any one of the pair of tubs.

11. The washing machine according to claim 1, further comprising a diaphragm formed on the detergent case to divide the first detergent storage part.

12. The washing machine according to claim 1, further comprising: a discharge guide pipe protruded upwardly from the second detergent storage part to discharge the detergent in the detergent box to the detergent case;

a cap to cover an upper end of the discharge guide pipe when the cap is separated from the upper end of the discharge guide pipe, wherein the cap comprises a plurality of stepped parts circumferentially spaced around the cap.

13. The washing machine according to claim 1, further comprising:

a pair of mounting holes provided in a front of the main body such that the detergent box and a second detergent box are removably installed, through the pair of mounting holes, into the detergent case and into a second detergent case associated with a second tub of the pair of tubs;

a through hole, associated with a holder for holding at least one of the detergent boxes, provided on the front of the main body, wherein the through hole is located separately from the pair of mounting holes and the through hole is provided at a lower position than at least one of the pair of mounting holes; and the holder rotatably connected to the front surface of the main body, and being located inside the through hole when the holder is in a closed position, the holder comprising:

a holding part, on which at least one of the detergent boxes separated from the main body and the detergent cases is held.

14. The washing machine according to claim 13, the holder further comprising:

a cover part that covers the through hole on the front of the main body when the holder is in the closed position.

15. The washing machine according to claim 13, wherein the holding part is formed on the inner surface of the holder.

16. The washing machine according to claim 1, wherein the detergent case is attached to a connection pipe which passes liquid from the detergent case to the least one tub, wherein the detergent box includes a discharge guide pipe to route the water supplied to the second detergent storage part through the detergent case, using siphon force, to the connection pipe without disturbing the contents of the first detergent storage case, and wherein water supplied to the first detergent storage part is routed to the connection pipe.

17. A washing machine comprising:

a main body;

at least one tub disposed in the main body;

a detergent supply device including:

a detergent case including a first detergent storage part configured to receive a first detergent, integrally formed with a bottom of the detergent case, and a detergent box separably installed in the detergent case, and including a second detergent storage part, configured to receive a second detergent, the second detergent storage part disposed above the first detergent storage part when the detergent box is installed in the detergent case, wherein water supplied to the second detergent storage part flows via the first detergent storage part, and then the water is supplied to the at least one tub in a state that includes the second detergent being separate from the first detergent, wherein the at least one tub includes a pair of tubs, and wherein the pair of tubs includes a first tub disposed in an upper portion of the main body and a second tub disposed in a lower portion of the main body, and the first detergent and the second detergent to be supplied to the first tub are respectively put into the detergent case and the detergent box;

a holding part, on which the detergent box separated from the main body and the detergent case is held; and a holder on which the detergent box separated from the main body is held, the holder comprising the holding part, wherein the holder includes a wire holder made of a wire.

* * * * *